US007434789B2

(12) United States Patent
Crumrine

(10) Patent No.: US 7,434,789 B2
(45) Date of Patent: Oct. 14, 2008

(54) PICKET FENCE ASSEMBLY

(75) Inventor: Scott C. Crumrine, Phoenix, AZ (US)

(73) Assignee: Allied Tube & Conduit Corp., Harvey, IL (US)

( * ) Notice: Subject to any disclaimer, the term of this patent is extended or adjusted under 35 U.S.C. 154(b) by 0 days.

(21) Appl. No.: 11/296,972

(22) Filed: Dec. 8, 2005

(65) Prior Publication Data

US 2007/0131919 A1 Jun. 14, 2007

(51) Int. Cl.
*B21F 27/00* (2006.01)

(52) U.S. Cl. ..... 256/22; 256/65.12

(58) Field of Classification Search ..... 256/21, 256/22, 65.11, 65.12, 65.13, 65.09
See application file for complete search history.

(56) References Cited

U.S. PATENT DOCUMENTS 189,543 A * 4/1877 Van Dorn ..... 256/22
3,113,760 A * 12/1963 Huret et al. ..... 256/59
3,736,714 A * 6/1973 Brenner ..... 52/300
4,883,256 A * 11/1989 Hebda ..... 256/22
5,150,885 A * 9/1992 Leone ..... 256/22
5,312,089 A * 5/1994 Venegas, Jr. ..... 256/65.12

* cited by examiner

*Primary Examiner*—Victor MacArthur
(74) *Attorney, Agent, or Firm*—Wyatt B. Pratt

(57) ABSTRACT

A picket fence assembly is provided which includes uniquely configured pickets which facilitate fast and easy construction of a picket fence without the need for additional mechanical fasteners. In one embodiment, the picket fence includes non-circular pickets, a first horizontal member and a second horizontal member. The first and second horizontal members include openings configured to receive respective pickets. Each picket includes at least one notch positioned to align with a respective opening in one of the first and second horizontal members. The notch facilitates rotation of the picket in relation to the one horizontal member to axially secure the vertical picket to the one horizontal member. The opening in the other horizontal member is oriented to non-rotatably receive the picket member after it has been secured to the one horizontal member. A method of assembling a picket fence assembly is also disclosed.

20 Claims, 8 Drawing Sheets

PICKET FENCE ASSEMBLY

BACKGROUND

1. Technical Field

The present disclosure relates to picket fence assemblies, and more particularly to a picket fence assembly including pickets having a unique configuration for facilitating easy and fast construction of a picket fence assembly without the need for the use of additional mechanical fasteners.

2. Background of Related Art

Picket fences and picket fence assemblies are well known in the art. A picket fence assembly typically includes a plurality of vertical pickets secured to at least two horizontal support members. A picket fence assembly may be constructed of wood, plastic, or the like. Picket fence assemblies may also include two or more vertical support members which receive and support the ends of the horizontal members.

The vertical pickets of picket fence assemblies may be secured to the horizontal members using any number of fastening devices or techniques. Generally, pickets are secured to horizontal support members using mechanical fasteners, such as nails, nuts and bolts, glue, and screws. Alternately, pickets can be secured to the horizontal support members by inserting the vertical pickets through openings in the horizontal support members and securing the vertical pickets to the horizontal support members with pins, rods, or a combination of pins or rods. Notches may be formed in the pickets to at least partially receive the pins or rods to effect securement. In either case, securing each individual vertical picket to each of the two or more horizontal members using mechanical fasteners is time consuming and requires additional material and equipment. Accordingly, a continuing need exists in the fence arts for a picket fence assembly which can be easily and quickly constructed at minimal cost.

SUMMARY

The present disclosure relates to a picket fence assembly having rotatably securable pickets. The picket fence assembly has a plurality of vertical pickets secured to a horizontal support member. The horizontal support member defines non-circular openings configured and dimensioned to slidably receive the vertical pickets. Each vertical picket defines at least one notch that is rotatably engagable with a portion of the horizontal support member defining the openings of the horizontal support member. A horizontal locking member is provided which also defines non-circular openings configured and dimensioned to non-rotatably receive pickets that have been previously rotatably engaged within the horizontal support member. The openings in the horizontal support member have a first orientation and the openings in the horizontal locking member have a second orientation angularly offset from the first orientation. The angular offset of the first and second orientations allows pickets which have been rotatably engaged with the horizontal support member to be slidably received in the horizontal locking member openings. In one embodiment, the first and/or second horizontal members have an inverted U-shaped cross section. Alternately, other configurations are envisioned. The picket fence assembly may be constructed of plastic, wood, metal, composites or the like.

In one preferred embodiment, the openings in the horizontal members are constructed such that rotation of a horizontal support member 180° about a vertical axis (an axis transverse to the longitudinal axis of the horizontal support member) reorients the openings in the horizontal support member from the first orientation to the second orientation. As such, each of the horizontal support members can be also used as horizontal locking members simply by rotating the horizontal support members 180° and each of the horizontal locking members can be used as horizontal support members by rotating the horizontal locking members 180°.

Vertical support members may be used to support the picket fence assembly. In one embodiment, the vertical support members define a channel and include side openings configured to receive and support the ends of the horizontal members. The ends of the horizontal members may be secured to the vertical member by a connector rod passing through the support member channel and openings formed in the ends of the horizontal members. Other securement techniques are envisioned, e.g., screws, pins, etc. The picket fence assembly may also include a connector sleeve for connecting the horizontal members to the vertical support members. The connector sleeve may be sized to receive one end of a horizontal member and may be received in a side opening formed in the vertical support member. The vertical and/or the horizontal members may also be provided with end caps.

In one embodiment, each of the vertical pickets has a triangular cross section having at least one notch formed therein. In a preferred embodiment, the pickets have an equilateral triangular cross-section. Correspondingly shaped openings are formed in the first and the second horizontal members and are dimensioned to receive the vertical pickets. The second horizontal member may be substantially identical to the first horizontal member, including the size and configuration of the openings. The notches formed in each vertical picket facilitate rotation of each picket with respect to the first horizontal member to axially secure each picket with respect to the first horizontal member. The vertical pickets and notches may be formed to rotate about 60° (degrees) within the opening formed in the horizontal member to effect securement. Alternately, other degrees of rotation are envisioned. Rotation of the vertical picket within the opening formed in the horizontal member prevents the vertical picket from sliding through, or being withdrawn from, the horizontal member. After the vertical picket has been axially secured to the first horizontal member, the picket can be inserted through the opening in the second horizontal member to rotatably fix the vertical picket in relation to the horizontal members. Other picket configurations are envisioned, e.g., square, pentagonal, star-shaped, rectangular, etc.

BRIEF DESCRIPTION OF THE DRAWINGS

Various embodiments of the presently disclosed picket fence assembly are described herein with reference to the drawings, wherein.

DETAILED DESCRIPTION OF THE PREFERRED EMBODIMENTS

Figure 1A:
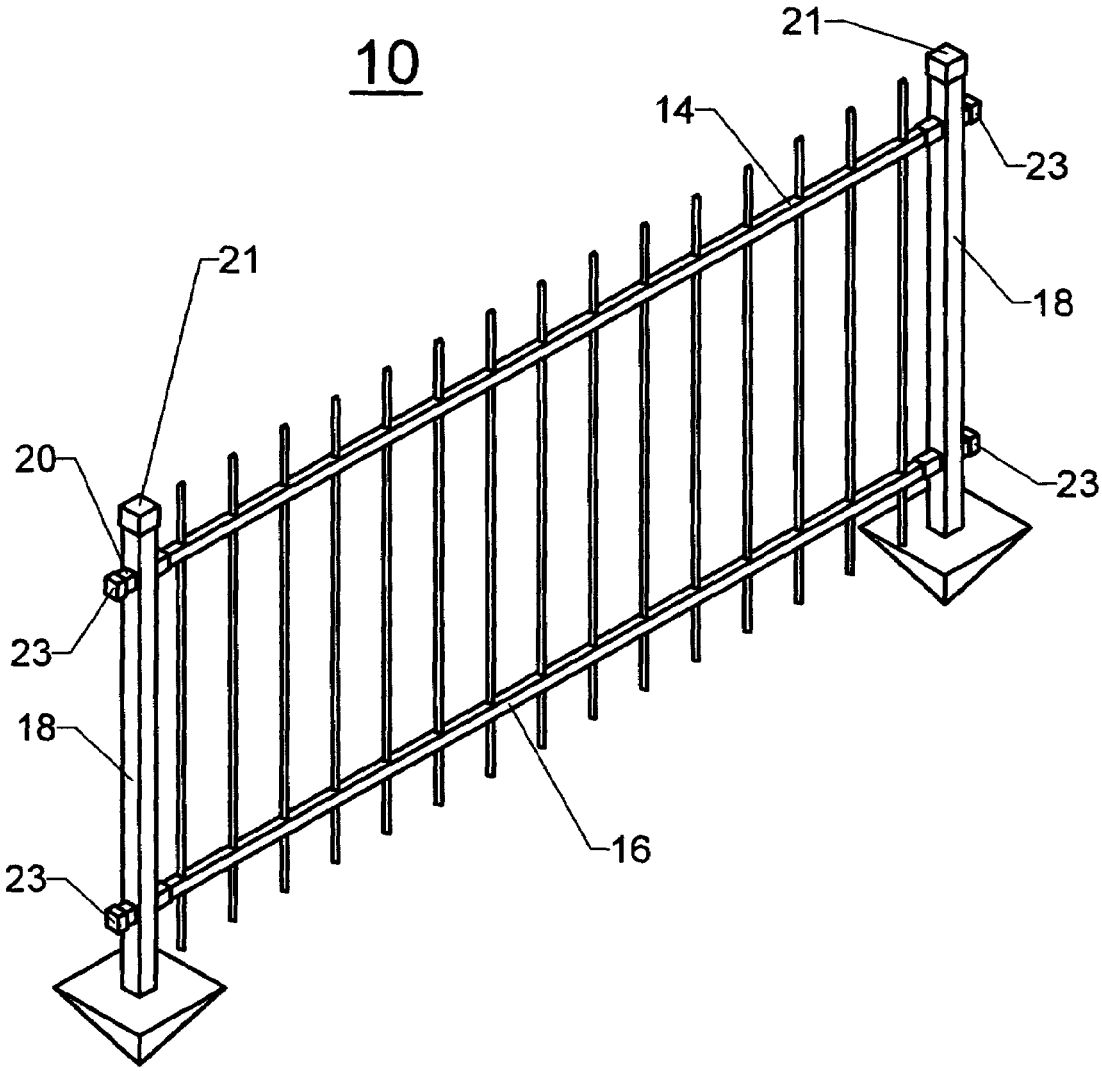
FIG. 1A is an isometric view of one embodiment of a picket fence assembly constructed in accordance with the present disclosure.

Embodiments of the presently disclosed picket fence assembly will now be described in detail with reference to the drawings in which like reference numerals designate identical or corresponding elements in each of the several views.

As used herein, the term "notch" is understood to mean any cutout, recess, indentation or the like which is formed in a portion of the picket to facilitate rotational movement of a picket in relation to a horizontal support member to axially fix the picket to the horizontal support member.

Figure 1B:
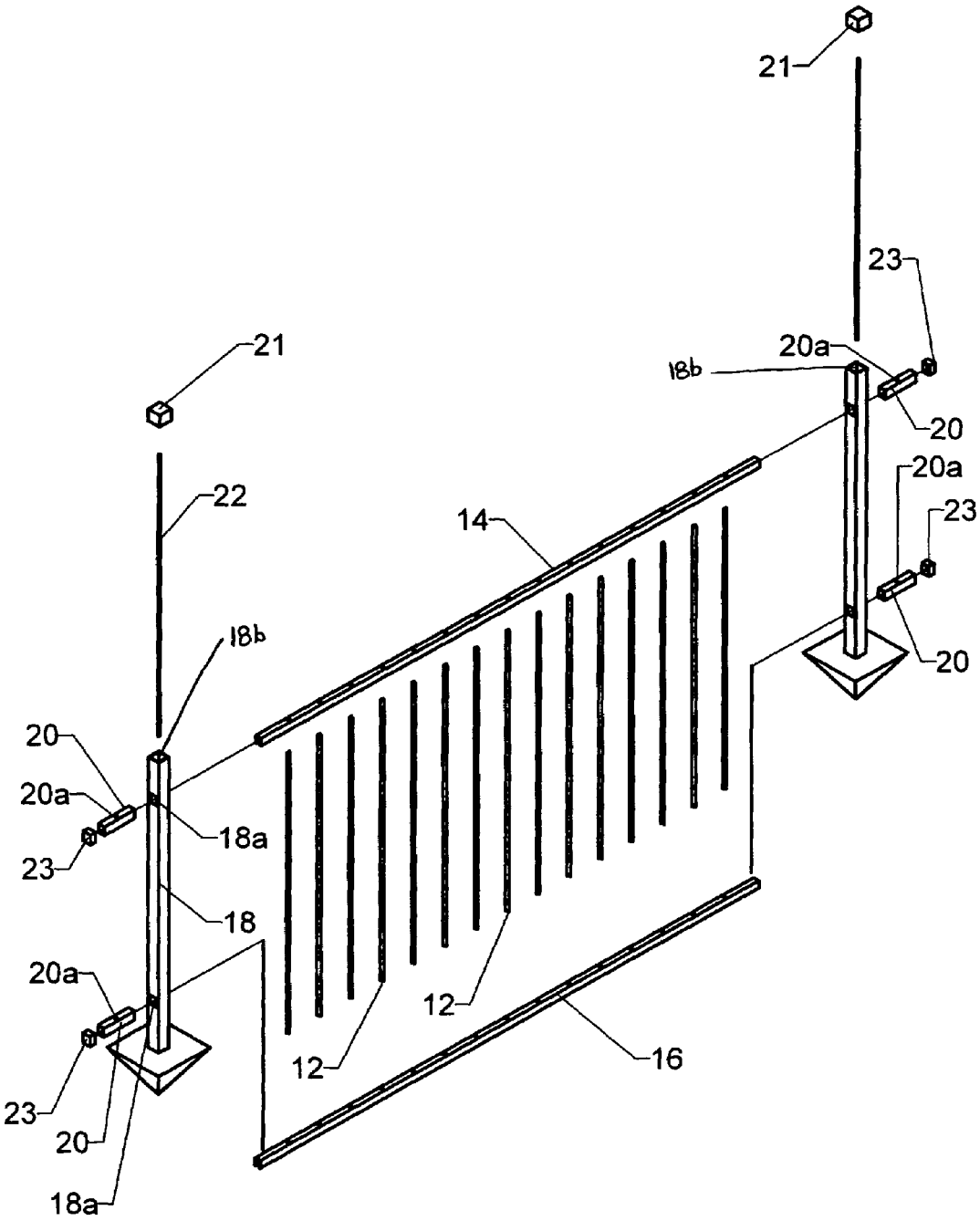
FIG. 1B is an exploded isometric view of the picket fence assembly shown in FIG. 1A.

FIGS. 1A and 1B illustrate a picket fence assembly constructed in accordance with the principles of the present disclosure. Referring to FIG. 1A, picket fence assembly 10 includes a plurality of vertical pickets 12, a horizontal support member 14 and a horizontal locking member 16. As shown, horizontal members 14 and 16 of picket fence assembly 10 are supported between vertical support members 18 and are coupled with vertical support members 18 by connector sleeves 20. Referring to FIG. 1B, vertical pickets 12 are dimensioned to be received through openings formed in horizontal member 14 and horizontal member 16 as will be discussed in detail below.

Connector sleeves 20 are configured and dimensioned to receive the ends of horizontal members 14 and 16 and be received in side openings 18*a* (FIG. 1B) formed in vertical support members 18. Connector sleeves 20 further define an opening 20*a* sized to receive a connector rod 22. Connector rod 22 is received through a vertical channel 18*b* (FIG. 1B) formed in supports 18 and openings 20*a* in connector sleeves 20 to fixedly secure horizontal members 14 and 16 to vertical support members 18. In a preferred embodiment, the connector rod can be in the form of a picket. In one embodiment, end caps 21 (FIG. 1A) may be added to vertical members 18 for aesthetics and/or prevent water from leaking into picket fence assembly 10. For these same reasons, end caps 23 may be provided for horizontal members 14 and 16 or connector sleeves 20. Additionally, appropriately configured end caps may be used on the top and bottom ends of the pickets. Side openings 18*a* of vertical support 18 may be positioned to receive two or more horizontal members wherein additional horizontal members may be provided to provide greater support or enhance picket locking. Further, openings 18*a* in vertical support members 18 may be provided and positioned such that the horizontal support members are aligned, are offset from each other by about 90 degrees, or alternately disposed.

Figure 2A:
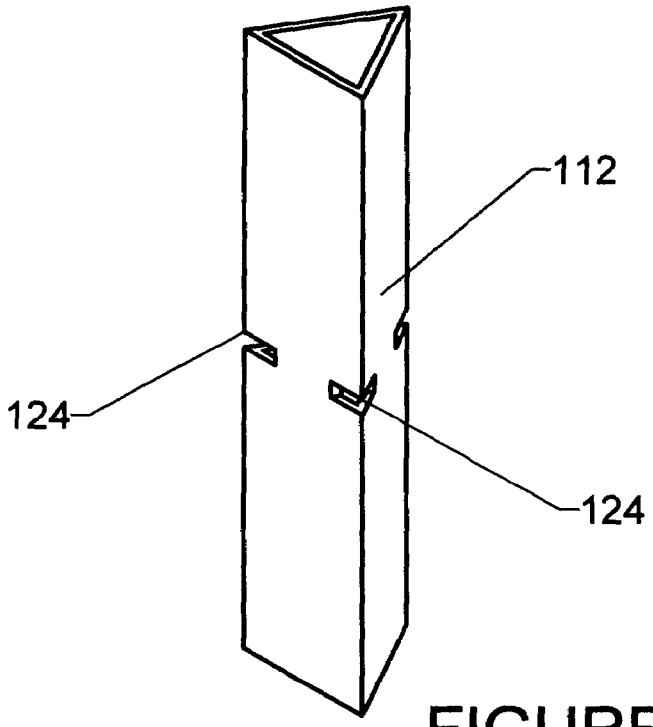
FIG. 2A is an enlarged isometric view of a portion of a vertical picket including horizontal notches.
Figure 2B:
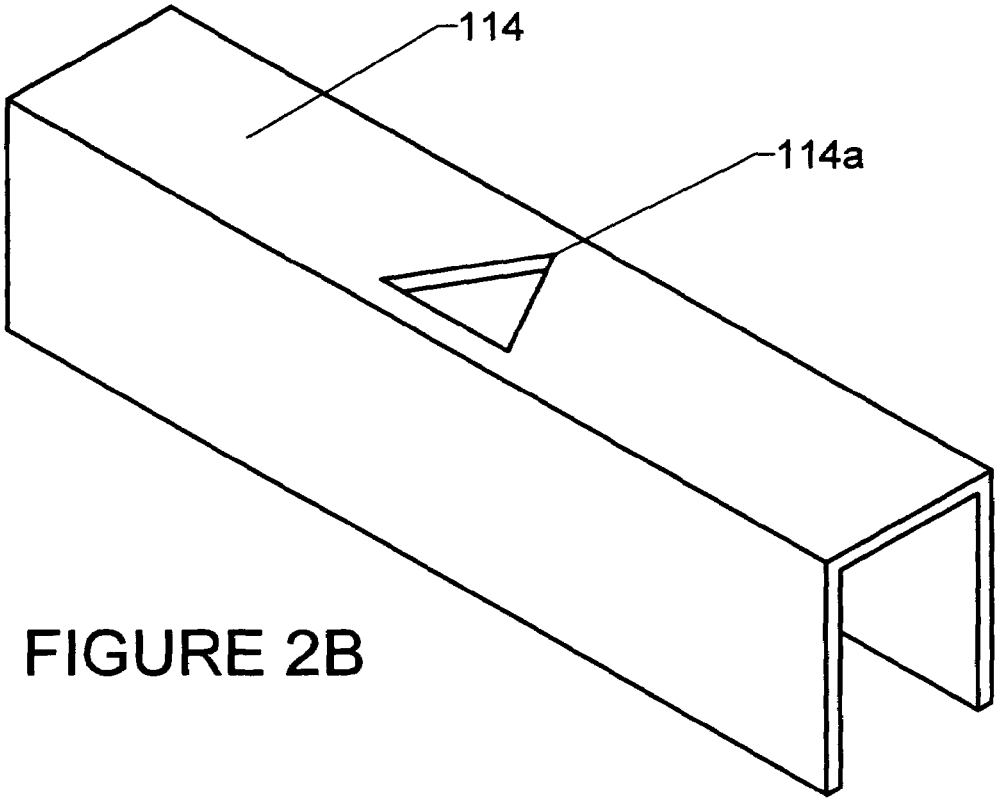
FIG. 2B is an enlarged isometric view of a portion of a horizontal support member defining an opening for receiving the vertical picket shown in FIG. 2A.

FIGS. 2A and 2B illustrate the components of one preferred embodiment of the presently disclosed picket fence assembly. Referring to FIG. 2A, vertical picket 112 has a triangular configuration and cross-section and defines a plurality of notches 124. Horizontal member 114 includes openings 114*a* (only one is shown) which has a shape which corresponds to the cross-section or configuration of vertical picket 112, i.e., triangular. When vertical picket 112 is positioned through (longitudinally inserted) openings 114*a* of horizontal member 114, notches 124 are positioned and configured to align with openings 114*a* such that when picket 112 is rotated about its longitudinal axis, notches 124 engage a portion of horizontal member 114 defining opening 114*a*. Notches 124 may be of any depth, width, height or configuration so long as axial rotation of vertical picket 112 portion of horizontal member 114 defining opening 114*a* within notches 124 to prevent picket 112 from being slid axially from opening 114*a*. Vertical picket 112 may be constructed of metal, wood, plastic, composites, or other compositions suitable for fence construction. Although vertical picket 112 is shown as being hollow, picket 112 may be solid. A vertical picket constructed in accordance with the principles of the present disclosure may have any non-circular cross sectional profile, including triangular, square, rectangular, pentagonal, trapezoidal, hexagonal, oval, star-shaped, etc.

As illustrated in FIG. 2B, horizontal member 114 defines an inverted U-shaped configuration and defines a triangular opening 114*a* sized to receive vertical picket 112 shown in FIG. 2A. Alternately, it is envisioned that horizontal member 114 may assume a wide variety of configurations including, but not limited to, square and rectangular configurations.

Figure 3A:
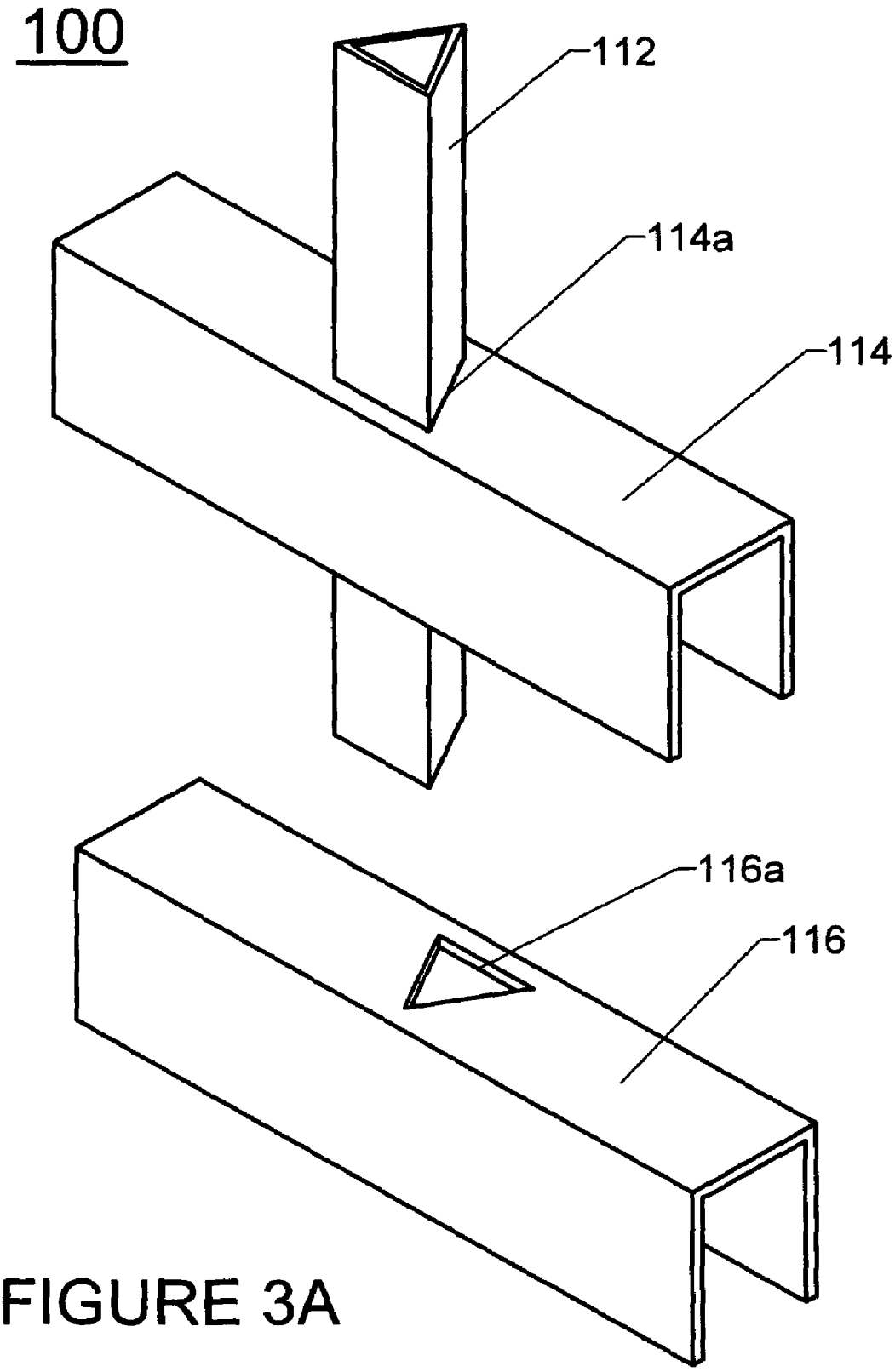
FIG. 3A is an isometric view of the vertical picket shown in FIG. 2A inserted through the horizontal support member shown in FIG. 2B and prior to rotation of the vertical picket and prior to insertion of the vertical picket through a horizontal locking member.
Figure 3B:
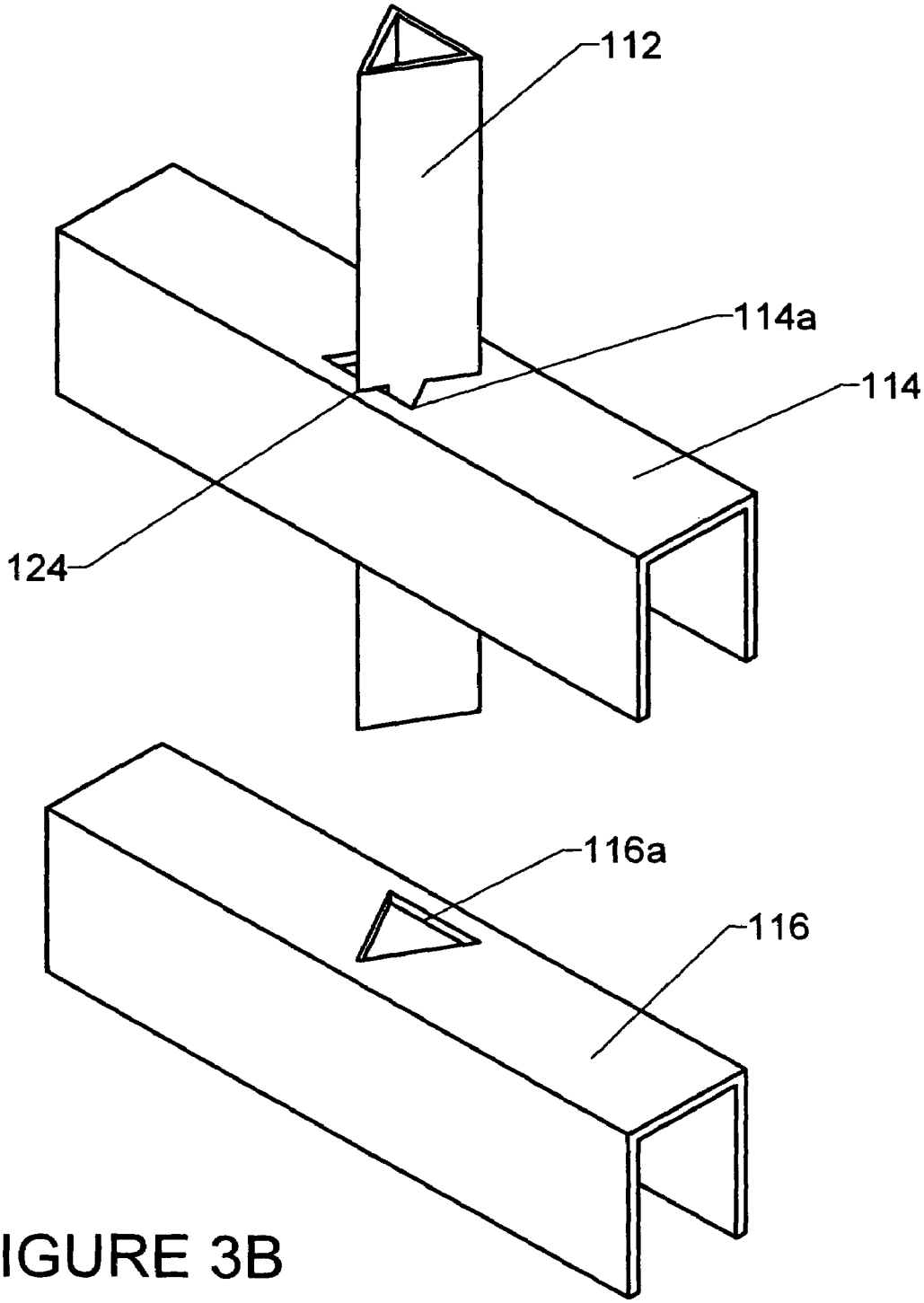
FIG. 3B is an isometric view of the vertical picket and horizontal members shown in FIG. 3A after rotation of the vertical picket about its longitudinal axis within the opening of horizontal support member, and prior to insertion of the vertical picket through the horizontal locking member.
Figure 3C:
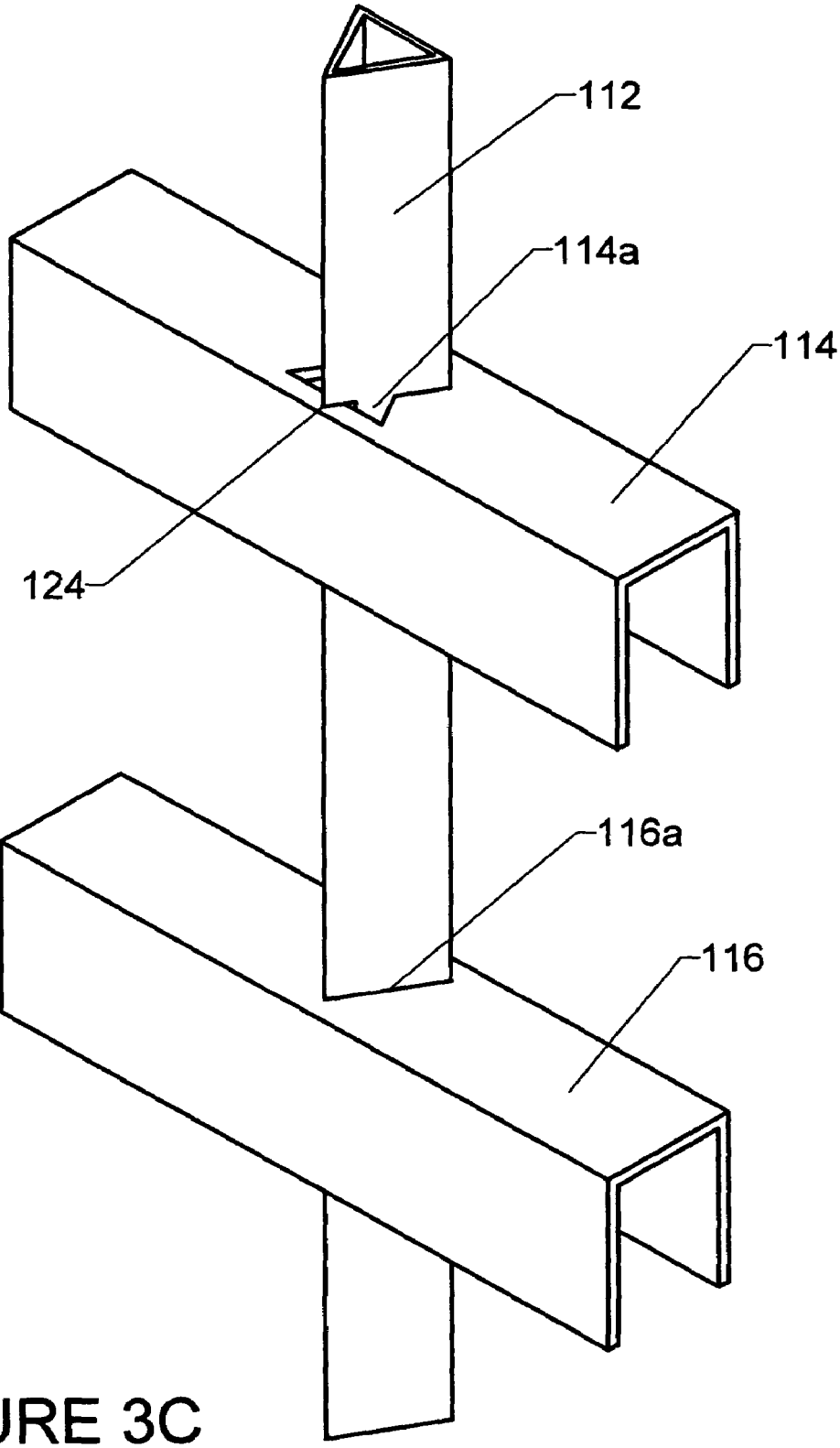
FIG. 3C is an isometric view of the vertical picket shown in FIG. 3A rotatably secured within the opening of the horizontal support member shown in FIG. 3A and extending through the opening of the horizontal locking member shown in FIG. 3A.

FIGS. 3A-3C illustrate the method or steps required to assemble a picket fence assembly constructed in accordance with the principles of the present disclosure. Referring to FIG. 3A, as discussed above, vertical picket 112 is inserted through triangular openings 114*a* in first horizontal member 114 to a position in which notches 124 are aligned with the portion of horizontal member 114 defining opening 114*a*. As of yet, vertical picket 112 has not be inserted into opening 116*a* defined by second horizontal member 116.

As illustrated in FIG. 3B, after vertical picket 112 is positioned to align notches 124 within opening 114*a* of horizontal member 114, vertical picket 112 is rotated axially to secure picket 112 within the opening 114*a* of first horizontal member 114 at notch 124. In the present embodiment, vertical picket 112 is rotated about 60° (degrees) to fully position horizontal notches 124 about the portion of first horizontal member 114 defining opening 114*a*. In alternate embodiments of the picket fence assembly, the amount of rotation required to fully secure vertical picket 112 to a horizontal support member may be varied and is dictated by the cross sectional profile of the vertical picket, the depth of the notches and the orientation of the opening in the horizontal locking member as will be discussed below. Preferably, the rotation of the picket required to effect securement to the horizontal support member does not exceed 90°. It is noted that, as of yet, vertical picket 112 has not been inserted into opening 116*a* of second horizontal member 116.

Referring to FIG. 3C, vertical picket 112, rotatably secured within horizontal support member 114 as shown in FIG. 3B, is inserted into triangular opening 116*a* of horizontal locking member 116. Triangular opening 116 is sized to receive vertical picket 112 so as to prevent further rotation of vertical picket 112. As illustrated in FIGS. 3B and 3C, opening 116*a* in horizontal member 116 is oriented to receive vertical picket 112 after vertical picket 112 has been rotatably secured to horizontal member 114. As such, if notches 124 were dimensioned to fixedly secure picket 112 to horizontal member 114 after a 40 degree rotation or 90 degree rotation of picket 112 (rather than a 60 degree rotation), the orientation of opening 116*a* of horizontal member 116 would have to be altered, i.e., reoriented to facilitate receipt of the vertical picket. When vertical picket 112 is received in opening 116*a* of horizontal member 116, vertical picket 112 is prevented from further rotation because notches are not provided in vertical picket 112 adjacent opening 116*a* of horizontal locking member 116. As such, vertical picket 112 is prevented from rotating and becoming disengaged from horizontal member 114 i.e., vertical picket is rotationally and axially locked in relation to horizontal members 114 and 116.

It is noted that in a preferred embodiment, vertical pickets 112 are first secured to horizontal members 114 and 116 and thereafter, horizontal members 114 and 116 are secured between vertical support members 18 (FIG. 1) in the manner discussed above. Alternately, second horizontal member 116 can be secured between vertical support members 18 and then vertical pickets 112, which are already secured to first horizontal member 116, can be positioned within openings 116*a* of second horizontal member 116. It is noted that although the upper horizontal member is shown as the support member and the lower horizontal member is shown as the locking member, the locking member and the support member may form either the upper or lower horizontal members, or intermediate horizontal members.

Figure 4A:
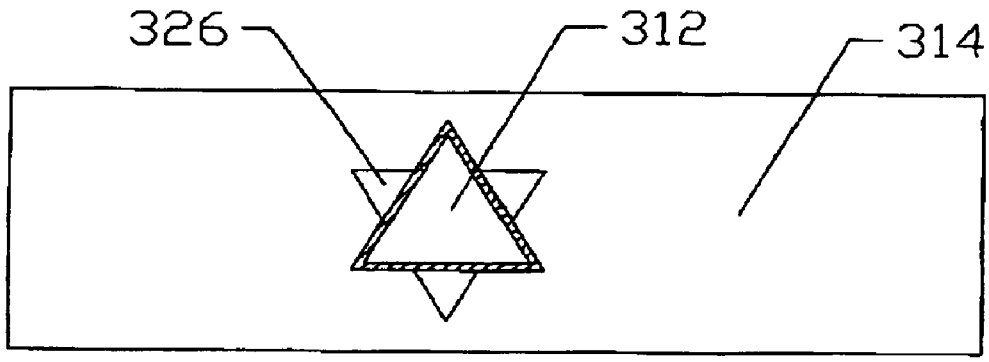
FIGS. 4A-4F are top cross sectional views of various alternate embodiments of the present disclosure showing a vertical picket rotatably secured within the opening of a horizontal support member.
Figure 4B:
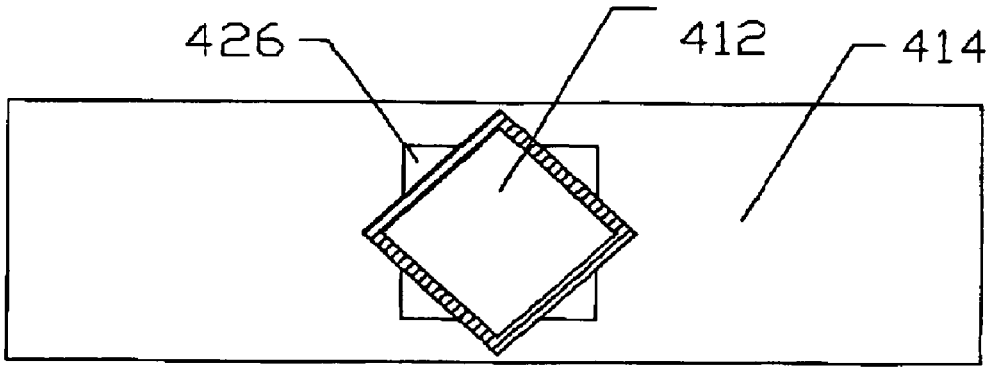
Figure 4C:
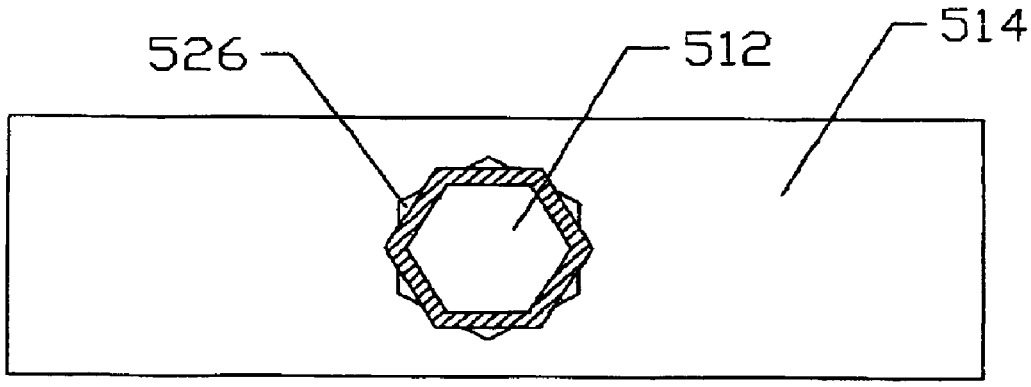
Figure 4D:
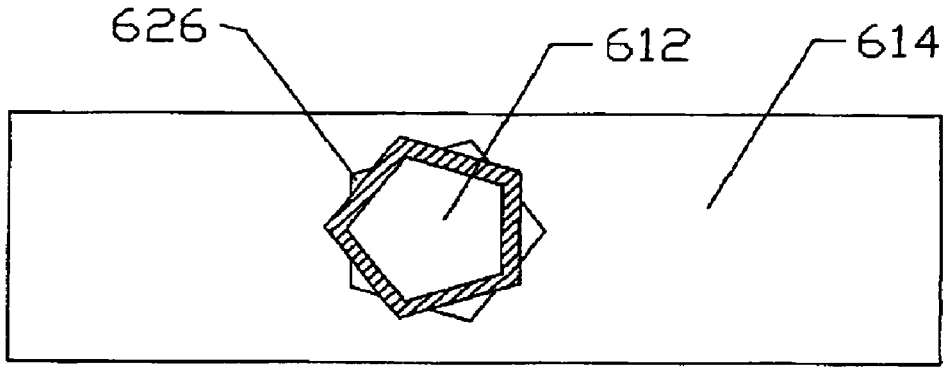
Figure 4E:
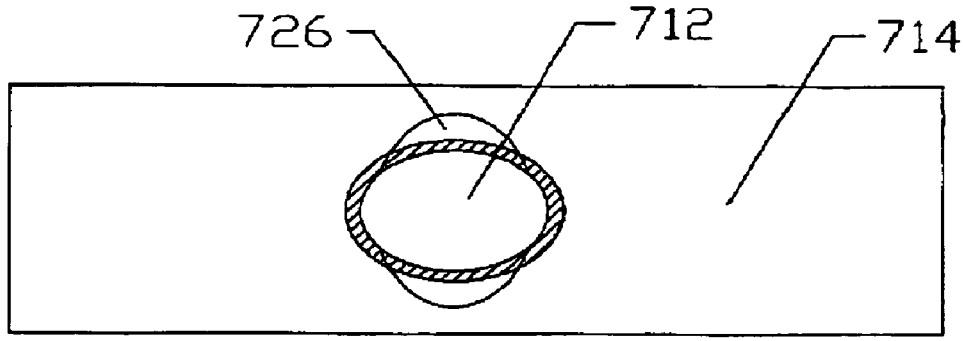
Figure 4F:
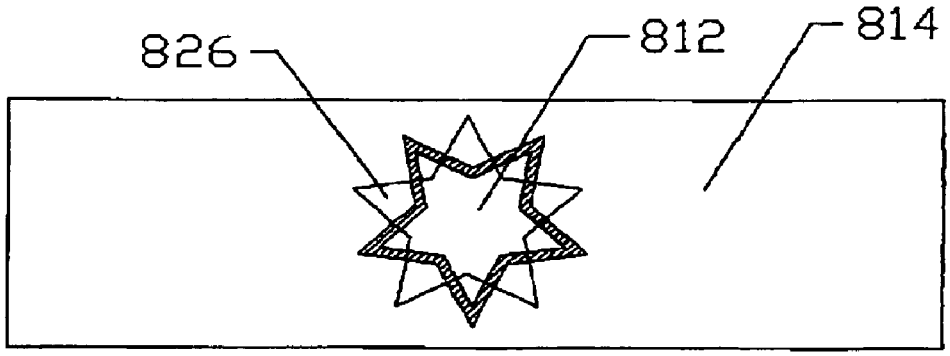

FIGS. 4A-4D illustrate various alternate embodiments of the vertical picket and horizontal support member secured together in accordance with the principles of the present disclosure. Referring to FIG. 4A, vertical picket 312, defining an equilateral triangular cross section, is rotatably engaged within equilateral triangular opening 326 of horizontal member 314. In one preferred embodiment, 60° rotation of picket 312 is required to secure picket 312 to horizontal support member 314. Alternately other degrees of rotation to effect securement are envisioned, e.g., 30°, 45°, etc. Referring to FIG. 4B, vertical picket 412, defining a square cross section, is rotatably engaged within square opening 426 of horizontal member 414. Referring to FIG. 4C, vertical picket 512, defining a hexagonal cross section, is rotatably engaged within hexagonal opening 526 of horizontal member 514. Referring to FIG. 4D, vertical picket 612, defining a pentagonal cross section, is rotatably engaged within pentagonal opening 626 of horizontal member 614. Referring to FIG. 4E, vertical picket 712, defining an oval cross-section, is rotatably engaged within oval opening 726 of horizontal member 714. Referring to FIG. 4F, vertical picket 812, defining a star-shaped cross-section is rotatably engaged within star-shaped opening 826 of horizontal member 814. Although each of the embodiments discussed above is shown and or described as being rotatably fastened to the upper horizontal member, the vertical pickets can just as easily be configured to be rotatably secured to the lower horizontal member in the same manner as discussed above with respect to the upper horizontal member. Accordingly, this disclosure contemplates both of these embodiments.

In one preferred embodiment, the openings in the horizontal members are oriented such that each of the horizontal members can function as either the support member or the locking member. More specifically, the openings in the horizontal members are oriented such that by rotating the horizontal member 180° about a vertical axis (an axis transverse to the longitudinal axis of the horizontal member), the opening in the horizontal member is reoriented from a support orientation to a locking orientation or vice-versa. For example, note that when horizontal support member 114 in FIG. 2B is rotated 180° about a vertical axis, the orientation of opening 114*a* assumes the orientation of opening 116*a* of horizontal locking member 116 as shown in FIG. 3A. As such, only a single configuration of the horizontal member need be provided which can be used to form either the horizontal locking member or the horizontal support member.

It will be understood that various modifications may be made to the embodiments disclosed herein. For example, holes may be formed in each end of the horizontal members such that the horizontal members can be secured directly to a vertical support member and no connector sleeve is required. Therefore, the above description should not be construed as limiting, but merely as exemplifications of preferred embodiments. Those skilled in the art will envision other modifications within the scope and spirit of the claims append hereto.

What is claimed is:

1. A picket fence assembly comprising:

a plurality of pickets, each of the pickets having a non-circular cross-sectional shape, and further having a first end portion and second end portion, the first end portion including at least one notch;

a one piece homogeneous horizontal support member defining a plurality of first openings having a cross-sectional shape identical to the picket cross sectional shape, each of the first openings being configured and dimensioned to slidably receive one of the pickets; and a one piece homogeneous horizontal locking member forming a plurality of second openings having a cross-sectional shape identical to the picket cross sectional shape, each of the second openings being vertically aligned and angularly offset from a respective one of the plurality of first openings of said horizontal support member;

wherein each notch of each of the plurality of pickets is capable of being positioned to be aligned with one of the first openings of the horizontal support member to facilitate limited rotation of each picket in relation to the horizontal support member such that, upon rotation, the notch of each picket receives a portion of the horizontal support member to axially secure the picket in relation to the horizontal support member, wherein each of the openings in the horizontal locking member is oriented to slidingly recieve each respective second end portion, the second end portion being continuous and notch-free to prevent rotation of each picket in relation to the horizontal locking member.

2. A picket fence assembly according to claim 1, wherein each of the plurality of pickets has a cross-sectional shape selected from the group consisting of substantially triangular, square, rectangular, pentagonal, trapezoidal, hexagonal, star-shaped and oval.

3. A picket fence assembly according to claim 2, wherein each of said pickets has a substantially triangular cross-section.

4. A picket fence assembly according to claim 2, wherein each of said pickets has a substantially rectangular cross-section.

5. A picket fence assembly according to claim 2, wherein each of said pickets has a substantially octagonal cross-section.

6. A picket fence assembly according to claim 1, further including first and second vertical support members, wherein the horizontal support and locking members are supported between the first and second vertical support members.

7. A picket fence assembly according to claim 6, further including a connector sleeve secured to each end of the horizontal support and locking members for securing each end of the horizontal support and locking members to a respective one of the first and second vertical support members.

8. A picket fence assembly according to claim 7, wherein each connector sleeve defines a bore configured to receive one end of a respective horizontal support or locking member and an opening configured to receive a connector rod, the connector rod extending through a channel formed in one of the first and second vertical support members and the bore of the connector sleeve to secure the respective vertical support member to the respective support or locking horizontal member.

9. A picket fence assembly according to claim 8, wherein each connector rod is in the form of one of the plurality of pickets and is positioned to secure one end of the first and the second horizontal members to a respective vertical support member.

10. A picket fence assembly according to claim 1, wherein the plurality of vertical pickets and the horizontal support and locking members are constructed of plastic.

11. A picket fence assembly according to claim 1, wherein at least one of the horizontal support and locking members define a cross-section selected from the group consisting of substantially inverted U-shape, square, and rectangular.

12. A picket fence assembly according to claim 11, wherein said cross-section is substantially an inverted U-shape.

13. A picket fence assembly according to claim 1, wherein the orientation of the openings in the horizontal support member and the horizontal locking member are such that rotation of the horizontal support member substantially 180°about a vertical axis reorients the openings of the horizontal support member to an orientation to facilitate use of the horizontal support member as a said horizontal locking member.

14. A method of assembling the picket fence assembly of claim 1, wherein the method comprises the following steps:

i) inserting one of the plurality of pickets through one of the openings in the horizontal support member to a position in which the at least one notch is aligned with the opening;

ii) rotating the one picket until at least a portion of the horizontal support member defining the opening is received in the at least one notch to axially fix the one picket in relation to the horizontal support member;

iii) optionally repeating steps i-ii to secure a plurality of pickets to the horizontal support member; and iv) inserting each of the pickets axially fixed to the horizontal support member through one of the openings in the horizontal locking member to rotatably fix the picket in relation to the horizontal support and locking members.

15. A method according to claim 14 further including the following step:

v) supporting each of the horizontal support and locking members between first and second vertical support members.

16. A method according to claim 15 further including the following step:

vi) securing a connecting sleeve to each end of the horizontal support and locking members and securing each connector sleeve to one of the first and second vertical support members.

17. A method according to claim 16, wherein each of the connecting sleeves defines an opening and each of the vertical support members defines a channel and further including the step of:

vii) positioning the sleeve at least partially within the channel of one of the vertical support members and inserting a connector through the channel and through the sleeve opening to secure the connector sleeve to the respective vertical support member.

18. A method according to claim 14, wherein the non-circular configuration of each of the pickets is selected from the group consisting of triangular, square, pentagonal, octagonal, trapezoidal, hexagonal, rectangonal, oval and star-shaped.

19. A method according to claim 18, wherein the non-circular configuration is substantially triangular.

20. A method according to claim 14, wherein the horizontal support member is constructed such that the rotation of the horizontal support member substantially 180°about an axis transverse to a longitudinal axis of the horizontal support member reorients the orientation of the first openings from the first orientation to the second orientation to facilitate use of the horizontal support member as a horizontal locking member.

* * * * *